United States Patent [19]

Wada

[11] Patent Number: 4,573,789

[45] Date of Patent: Mar. 4, 1986

[54] DUPLEX COPYING SYSTEM

[75] Inventor: Kenichi Wada, Osaka, Japan

[73] Assignee: Minolta Camera Kabushiki Kaisha, Osaka, Japan

[21] Appl. No.: 484,577

[22] Filed: Apr. 13, 1983

[30] Foreign Application Priority Data

| | | | |
|---|---|---|---|
| Apr. 13, 1982 | [JP] | Japan | 57-62085 |
| Apr. 16, 1982 | [JP] | Japan | 57-64442 |
| Apr. 16, 1982 | [JP] | Japan | 57-64443 |
| Apr. 19, 1982 | [JP] | Japan | 57-65628 |
| Apr. 21, 1982 | [JP] | Japan | 57-67924 |

[51] Int. Cl.[4] ..... G03G 15/00

[52] U.S. Cl. ..... 355/14 SH; 355/3 SH; 355/3 R; 355/8

[58] Field of Search ..... 355/3 R, 3 BE, 14 TR, 355/14 SH, 23, 24, 25, 26, 3 SH; 271/23, 34, 35, 65, 118, 180, 181, 184, 185, 186, 189, 191, 197, 198, 199, 202, 225, DIG. 9

[56] References Cited

U.S. PATENT DOCUMENTS

| | | | |
|---|---|---|---|
| 3,140,089 | 7/1964 | Greenblott et al. | 271/185 X |
| 3,942,786 | 3/1976 | Lauren | 271/177 |
| 4,098,551 | 7/1978 | Komori et al. | 355/3 R |
| 4,110,025 | 8/1978 | Tabata | 355/24 X |
| 4,116,558 | 9/1978 | Adamek et al. | 355/24 |
| 4,214,743 | 7/1980 | Meier | 271/184 X |
| 4,229,101 | 10/1980 | Hamlin et al. | 355/23 X |
| 4,278,344 | 7/1981 | Sahay | 355/14 SH |
| 4,313,673 | 2/1982 | Wartinger et al. | 355/23 X |
| 4,330,197 | 5/1982 | Smith et al. | 355/23 X |
| 4,346,881 | 8/1982 | Frye | 271/202 X |
| 4,365,886 | 12/1982 | Murakami et al. | 355/23 X |
| 4,384,782 | 5/1983 | Acquaviva | 271/197 X |
| 4,403,851 | 9/1983 | Yanagawa | 355/3 BE X |
| 4,411,517 | 10/1983 | Gerken | 355/14 SH |
| 4,436,302 | 3/1984 | Frye et al. | 271/202 |
| 4,453,819 | 6/1984 | Wada et al. | 271/DIG. 9 X |

FOREIGN PATENT DOCUMENTS

| | | | |
|---|---|---|---|
| 0163550 | 12/1980 | Japan | 355/14 R |
| 0176066 | 10/1982 | Japan | 355/14 R |
| 0054352 | 3/1983 | Japan | 355/26 |
| 2059392 | 4/1981 | United Kingdom | 271/202 |

*Primary Examiner*—Bernard Roskoski
*Assistant Examiner*—Shik L. P. Ip
*Attorney, Agent, or Firm*—Watson, Cole, Grindle & Watson

[57] ABSTRACT

A duplex copying apparatus is provided in the space therebelow with a duplex copying auxiliary means for returning a sheet having an original copied thereon to a sheet feed path extending from a sheet discharge station of the copying apparatus to an image formation station of the apparatus. A support unit for exclusive use in the copying apparatus is detachably provided with a copied sheet return station of the duplex copying auxiliary means.

12 Claims, 17 Drawing Figures

DUPLEX COPYING SYSTEM

BACKGROUND OF THE INVENTION

1. Field of the Invention:

This invention relates to a duplex copying mechanism.

2. Prior Art:

The conventional copying apparatus designed to copy both sides of a copy sheet is disclosed, for example, in U.S. Pat. No. 4,098,551 (Komori et al., patented July 4, 1978), in which an intermediate tray is disposed between upper and lower paper feed cassettes and a copied sheet discharge tray. Each copy paper sheet applied from a paper feed station to an image formation station and thereby having an image transferred thereon is stored in layers in the intermediate tray. The image-transferred copy paper sheets thus stacked in the intermediate tray are successively sent to the image formation station again, and then the paper sheets each have the underside thereof copied to finish duplex copying.

In the apparatus of the type described above, since the intermediate tray for copying both sides of copy sheets has to be disposed between the paper feed cassette disposed in upper and lower positions and the copied sheet discharge tray, the copying apparatus is enlarged in size. On the other hand, in the intermediate tray are the orderly stored copy sheets having the upper side thereof copied and on which electrostatic attraction due to corona charge produced in the step of transferring an image on one side of the copy paper sheet is liable to be retained. Because of this fact, it is difficult to feed one by one those copy sheets having one side copied in order to copy the other side because the paper sheets are electrostatically attracted to each other while the paper sheets are orderly stacked without getting out of place.

It is also difficult to deal one after another with copy paper sheets supplied in sheets stacked one over another and there is a possibility of the sheets having one side thereof copied being supplied at a time in several sheets to copy the underside of the copied sheet. Moreover, when each copy sheet having one side thereof copied and stacked in the intermediate tray is delivered one after another by sheet feed rollers, the copying apparatus often becomes stained with a copied image by the apparatus being pressed into contact with the sheet feed rollers and being pushed with respect to the copy sheet.

Conventionally, in the duplex copying apparatus, a duplex copying mechanism was incorporated into the main body of the copying apparatus, and accordingly, a user had to buy an expensive large-size apparatus whether or not it was intended to make both side copying at the time the duplex copying apparatus was purchased.

In another prior art apparatus the sheet velocity decreases as the sheet is transferred from a pair of drive rollers to the conveyor so as to provide a suitable slowing of velocity for laying the sheet, as for example described in the U.S. Pat. No. 3,942,786 (Unto Antero Lauren, patented Mar. 9, 1976). Such sheet laying means, however, provides for a sheet pile device.

SUMMARY OF THE INVENTION

A primary object of this invention is to provide a duplex copying mechanism which avoids the disadvantages of the conventional duplex copying apparatus.

Another object of the invention is to provide a duplex copying mechanism capable of achieving both side copying without increasing the size of the apparatus.

Still another object of the invention is to provide a duplex copying mechanism which avoids the possibility of the mechanism becoming stained by the copy paper sheets being rubbed against each other or being strongly rubbed by the sheets being pressed into contact with paper feed rollers.

This invention makes it possible to copy either one or both sides of a copy paper sheet without increasing the size of copying apparatus by slidably storing a duplex copying unit in a stand for mounting the main body of the copying apparatus thereon.

These and other objects and features of the invention will become more apparent from the following description of preferred embodiments of the invention given in conjunction with reference to the accompanying drawings.

DESCRIPTION OF THE PREFERRED EMBODIMENTS

Figure 1:
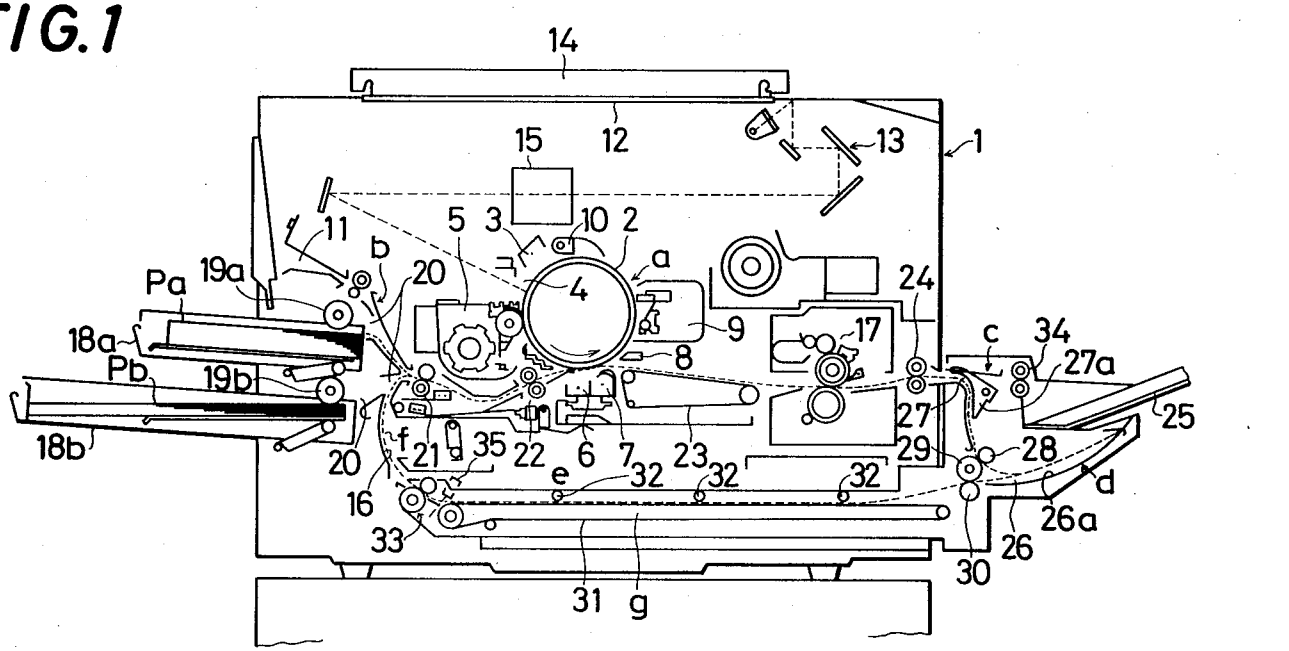
FIG. 1 is a sectional view of a duplex electrostatic copying copying apparatus showing a preferred embodiment of the invention.

FIG. 1 is a sectional view of one embodiment of the duplex electrostatic copying apparatus according to the invention, the numeral 1 designating a main body of the copying apparatus which is provided in approximately the middle thereof with a photosensitive drum 2 adapted to be driven in the direction of rotation indicated by an arrow. The drum 2 is provided therearound with an image formation unit a including a charger 3, exposure slit 4, development device 5, transfer charger 6, separation decharger 7, separator claw 8, cleaning device 9 and an eraser lamp 10 which are sequentially disposed in the arrow-indicated direction of rotation of the drum 2 and operate sequentially upon the surface of the drum in accordance with rotation of the drum 2 to transfer a toner image onto the copy paper sheet conveyed in synchronism with rotation of the drum 2.

In the image formation unit a, firstly, the portion cleaned by a cleaning device 9 on the surface of the photosensitive drum 2 is decharged by an eraser lamp 10 and is thereafter charged by a charger 3. The charged surface of the drum 2 is exposed by a scanning optical system 13 through an exposure slit 4 and an electrostatic latent image of an original (not shown) placed on an original receiving glass 12 is formed on the surface of the drum 2.

Next, the image is developed by developing device 5, and the developed image is transferred by transfer charger 6 onto the copy sheet. The copy sheet having an image transferred thereon is separated from the surface of the drum 2 by separation decharger 7 and separation claws 8. After the copy paper sheet is separated therefrom, the residual toner on the surface of the drum 12 is scraped off by cleaning device 9 and then the surface of the drum 2 enters into a charge erasing step to erase the residual charge thereon by eraser lamp 10.

The numeral 14 designates an original presser plate, which is secured to the upper surface of the main body 1 so as to be openable relative to original receiving glass 12. The numeral 15 designates an imaging lens of scanning optical system 13.

On the left side of image formation station a there is provided a copy paper feed station b which feeds the copy sheet into a transfer station, i.e. the portion between the photosensitive drum 2 and the transfer charger 6. On the right side of the image formation station a there are provided a fixing device 7 for fixing through fusing by heat the toner image transferred onto a copy paper sheet separated from the drum 2 after the transfer, and a sheet discharge station c for discharging the copied paper passed through the fixing device 17 in the manner that both the fixing device 17 and the station c are brought into an approximately lateral line near the lower portion of the drum 2. In the paper feed station b there are provided copy paper feeding cassettes 18*a* and 18*b* for storing therein two types of copy sheets Pa and Pb of different sizes in the manner that the cassettes extend outwardly from one side of the main body of the copying apparatus. By selective driving of paper feeding rollers 19*a* and 19*b* respectively provided for the cassettes 18*a* and 18*b*, either one of the selected sheets Pa and Pb is fed into a paper feed path 20. The copy paper sheet thus fed out is fed onto a transfer station located below the photosensitive drum 2 through a pair of adjusting rollers 21 and a pair of timing rollers 22 in synchronism with the movement of a toner image on the drum 2. The numeral 11 designates a manual insertion portion for copy paper sheets.

The paper feeding rollers 19*a* and 19*b* are driven by transmitting a driving force from a driving power source (not shown) through a clutch mechanism as of a known spring clutch and solenoid. A paper feed timing signal is given in the form of operation timing for the solenoid. The pair of adjusting rollers 21 are initially stopped to once receive the copy sheet Pa or Pb conveyed from one of the copy paper feeding cassettes 18*a* 18*b* and then correct the slant travel thereof. Subsequently thereto, the rollers 21 feed the sheet to the pair of timing rollers 22 by being driven in properly timed interlocking relation with the copying operation. The roller pair 22 also is initially held stopped to once receive the sheet Pa or Pb sent from the rollers 21, and thereafter feed the sheet Pa or Pb to the transfer station by a timing roller operating signal outputted in final synchronization with the toner image to be formed on the photosensitive drum 2.

The numeral 23 designates a transfer belt for feeding the copy paper sheet sent from the transfer station to the fixing unit 17, and the numeral 24 designates discharge rollers for discharging the copied paper sheet fed from the fixing unit 17 to a copied sheet discharge unit c. On the copied sheet discharge unit c there is provided a paper sheet tray 25 for stacking the copied and discharged paper sheets therein.

Below the aforestated ordinary copying apparatus is provided a duplex copying auxiliary means for returning a sheet having one side copied to an image formation station a in the condition of the side copied sheet being turned over so as to subject the turned over sheet to copying of the other side of the sheet. The duplex copying auxiliary means includes a switchback unit d for effecting a changeover of the leading end to the trailing end of the one side copied sheet to return the sheet to the image formation station a, and a reversing station f for returning the side copied and switchbacked sheet to the image formation station a in a turned over condition of the sheet.

The switchback unit d is formed detachably and laterally rectangular in a flat space e lying below the paper feed station b, image formation station a, and fixing unit 17, as will be described later. The tray 25 is detachably mounted at that one end portion of the switchback unit d projecting from the copying apparatus body 1 to the sheet discharge side. The switchback unit d is provided with a sheet discharge unit c having a pair of sheet discharge rollers 24 for feeding the copied sheet to the tray 25 and a switchback station 26 for switching back the one side copied sheet discharged from the rollers 24. The unit d is further provided with a sheet direction switching gate 27 having guide pawls 27*a* and designed to change the direction of passage of the sheet fed from the discharge rollers 24 either over to the sheet discharge tray 25 side or over to the switchback station 26 in response to a selection signal outputted before copying as to whether the sheet undergoes one side or both side copying.

The switchback station 26 is provided with an upwardly open switchback guide plate 26*a* which is smaller than a minimum size copy sheet usable in the apparatus and is slightly curved in a downwardly convexed manner. The station 26 further includes a pair of introduction rollers 28, 29 for introducing the sheet sent downwardly from the gate 27. The station 26 also includes a pair of rollers 29, 30 for delivering the sheet sent into the switchback guide plate 26*a* from the rear end of the plate 26*a* in cooperation with one roller 29 of the rollers 29 and 30.

Figure 2:
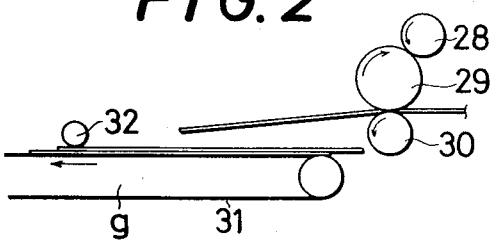

At that portion of the switchback unit d which is inserted into the lower flat space e of the copying apparatus there is provided a return feed station g comprising a belt 31 for feeding to the image formation station a side the copied sheet which was fed from the feed rollers 29 and 30 in the switchback guide plate 26*a* and which has its leading end changed for its trailing end, and further comprising a plurality of auxiliary rollers 32 in contact with the transfer surface of the belt 31. On the left side of the space e there are disposed sheet feeding rollers 33 for feeding the sheet to be returned toward the copy paper feed path 20 and returning the sheet to the image formation station a through the path 20 for copying the underside of the copy sheet. A reversion station f for guiding and returning the upside copied sheet fed from the sheet feeding rollers 33 to the path 20 is formed of a curved path 16 for permitting advance of the upside copied sheet toward adjusting rollers 21 in the upside condition of the sheet being reversed. The duplex copying auxiliary means is designed to be driven simultaneously with the copying means for example by bringing a driven gear in the switchback unit d into mesh with a gear of the discharge rollers 24, which interlocks with a copying apparatus driving mechanism in the body 1, when the unit d is mounted on the body 1. Sheet discharge rollers 34, introduction rollers 28, 29 and feed rollers 29, 30 of the switchback station 26, and feeding rollers 33, in the duplex copying auxiliary means in this embodiment are made substantially equal in sheet feed speed (for example, 13 cm/sec; hereinafter referred to as system speed if necessary) to the copying means. In contrast thereto, a return belt 31 is driven through reduction means such as gears at lower feed speed (for example, 7.5 mm/sec) than the system speed. By this, when the number of sheets copied per minute at the system speed of 13 cm/sec amounts to 25 sheets, the time required for obtaining the unit number of copied sheets amounts to 2.4 sec. per sheet. Accordingly, the upside copied sheet fed from the switchback station 26 onto the low-speed return belt 31 amounts to the number of sheets represented by the equation 7.5 mm/sec×2.4 sec/sheet=18 mm/sheet, which means that the copied sheet to be returned travels only 18 mm while one sheet is being copied. Accordingly, when upside copying is carried out continuously, the upside sheets successively fed onto the return belt 31 are returned at a low speed while being brought into the state of the succeeding sheets overlying sequentially the preceding sheets in longitudinally staggered relation with each other by 18 mm on the belt 31 as shown in FIG. 2.

Suppose that the length of a sheet passage path on the return belt 31 is 580 mm and that the sheet of 44 size (210×297 mm) is fed transversely (in a side-by-side relation with the short sides of the sheet faced in the direction of feed), Then by the time that the foremost sheet on the return belt 31 has reached the underside copying sheet feed rollers 33, and thereby feeding for the underside copying becomes possible, the maximum number of 20 upside copied sheets is stacked on the return belt 31 as shown by the following equation:

$$(580\text{ mm}-210\text{ mm})\div 18\text{ mm/sheet}\approx 20\text{ sheets}$$

Figure 3:
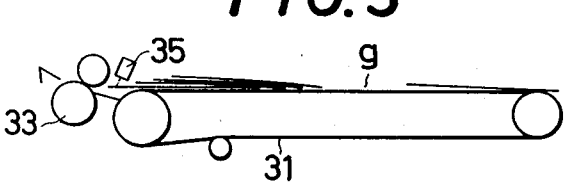
FIGS. 2 and 3 are side views respectively showing the condition of a copy sheet being fed by both side copying auxiliary means.

The state of the upside copied sheets having become ready for copying the underside thereof is detected by a photosensor 35 detecting the foremost end of the sheet when the foremost upside copied sheet on the feed belt 31 has reached the left end portion of the return station g, as shown in FIG. 3. For replacing or turning over the original for underside copying prior to initiation of the copying of the underside of the sheet, the copying means and the duplex copying auxiliary means are temporarily stopped when the completed state of preparation for the underside copying is detected.

Starting of copying the underside of the copy sheet is carried out by operation of an underside copying start switch not shown. In this case, it will be understood that the copy sheet feed station b in the copying means is kept inoperative so as to prevent feeding of ordinary copy sheets from cassettes **18*a* and 18*b***.

By so doing, only those upside copied sheets lying on the return belt 31 are transferred one after another through the reversing station f to an image formation station a by the feeding rollers 33 with the sides of sheets being reversed. Namely, the sheets are fed to the image formation station a in properly timed relation with each other through timing adjustment by stop-adjustment roller 21 and auxiliary timing roller 22. The time interval needed for each of the copied sheets on the return belt 31 to reach the sheet feeding roller 33 amounts to 2.4 sec per sheet as expressed by the equation:

$$18\text{ mm}\div 7.5\text{ mm/sec}=2.4\text{ sec}$$

Accordingly, the upside copied sheets can be fed out at the same speed and with the same efficiency as ordinary feeding operation of paper feed station b.

The underside copied sheet is fed onto the sheet discharge tray 25 according to the both side copying instructions already given. Namely, since the guide pawls **27*a* which had been switched over so as to receive the upside copied sheet into the switchback unit d have been caused to return to their original positions in accordance with the output as of an operational signal of the underside copying start switch, the copy sheet is caused to pass from discharge rollers 24 to a sheet discharge station c, and is transferred onto the sheet discharge tray 25 through the sheet discharge rollers 34**.

The maximum number of both side copied sheets capable of being produced during one cycle amounts to 20 copies equal to the maximum number of copied sheets capable of being retained on the return belt 31. It will be understood that the maximum possible number of sheets can optionally be set by the length of the return belt 31 and the driving speed of return belt 31.

If the necessary number of sheets to be copied in one cycle of both side copying operation is less than 20 copies, it requires after having completed the necessary number of upside copying the same period of time as the case with 20 sheets copying for the foremost upside copied sheet to reach the specified position on the return belt 31 where the upside copied sheets are ready for underside copying. But from the time of completion of upside copying until the time of completion of preparation for underside copying, operation of reversing an original for subjecting the original to underside copying is carried out. Accordingly, since underside copying can be started approximately with the completion of preparation for the underside copying, waiting time due to difference in the number of sheets to be copied does not result in the loss of time.

For detecting the sheet having reached the position in which the upside copied sheet has completed preparation for underside copying, there are various means provided, in addition to the photosensor 35 described above, such as a lead switch, microswitch, or ultrasonic wave sensor.

According to the invention, there is additionally provided a duplex copying auxiliary means for switching the upside copied sheet back to an image formation station side of the copying means and returning the sheet upside down to the image formation station to thereby subject the sheet to underside copying, and the copied sheet returning speed by the auxiliary means is made lower than the system speed of the copying means. By this, the upside copied sheets which are continuously copied at the system speed are returned to the image formation station with the sheets being one over another in longitudinally staggered relation by the difference in speed along the return path to the image formation station, and only after the foremost upside copied sheet has reached the specified return position, the sheets retained on the return path are successively returned to the image formation station and subjected to continuous underside copying. Accordingly, there is no need for providing such an intemediate tray as was conventionally disposed, with the result that an increased size of the copying apparatus can be avoided and efficient both side copying can be carried out in the manner that upside copying and underside copying are respectively effected continuously in large quantities. Furthermore, there is invariably produced, with the upside copied sheets being overlapping retained on the return path through the returning on the upside copied sheets to the image formation station, a certain amount of dislocation or slip in position due to the difference between the system speed and the upside copied sheet feed speed. For this reason, when compared with the case in which many upside copied sheets are stacked in accurate layers in an intermediate tray, adhesion of the sheets to each other is slight. In addition thereto, since only the foremost one of the copied sheets returned at a low speed is invariably nipped between the sheet feed rollers for returning the copied sheet to the image formation station at the system speed and is subjected to underside copying, the mechanism so operating makes it easy to prevent double feed in underside copying. Also, stain of copied sheets resulting as conventionally from pressure contact between the feed rollers and the copied sheets stacked on the intermediate tray can be avoided. Moreover, all that is necessary is to drive the duplex copying auxiliary means simultaneously with the copying means and there is no necessity of timing as by the use of a clutch with the result that control of the apparatus is faciliated and the structure thereof is also simplified.

Figure 4:
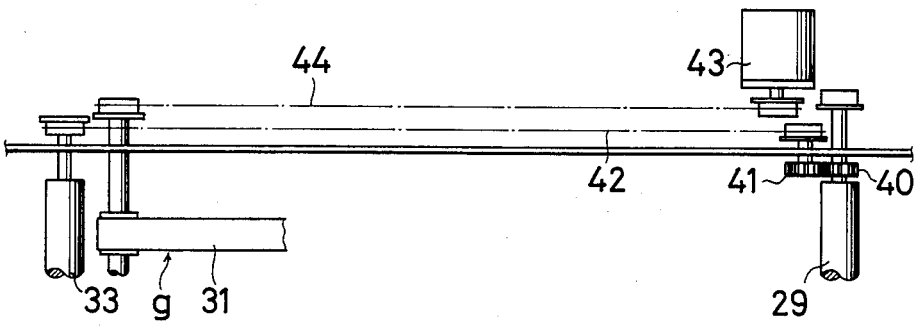
FIGS. 4 and 5 are respectively a plan view and a side view of a modification of the FIG. 3 embodiment.
Figure 5:
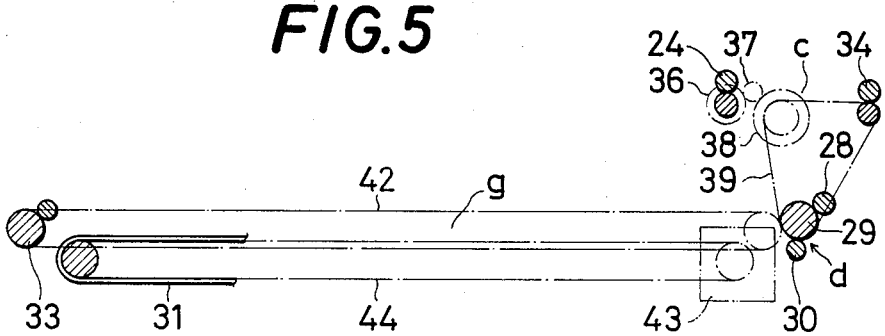

The mechanism shown in FIGS. 4 and 5 makes it possible to drive the sheet returning device for the duplex copying auxiliary means independently of the copying mechanism and to drive the sheet returning device intermittently by a certain amount every time a copying operation is performed in the copying means. The mechanism is so designed that the upside copied sheets successively received into the duplex copying auxiliary means are returned to the return path along the way to the image formation station with the sheets lying one over another staggered from each other by the amount equal to the single drive of the copy sheet returning device. The mechanism operates in such a manner that, only when the foremost one of the upside copied sheets has reached the specified return position, the upside copied and returned sheets retained on through the returning path 20 are successively returned to the image formation station in the same manner as shown in the FIG. 1 embodiment for continuous underside copying.

Returning to the embodiment with reference to FIG. 5, a driven gear 38 in the switchback unit d is brought into mesh with an intermediate gear 37 adapted to be reversed in the direction of rotation in meshing with a gear 36 connected to a driving shaft of the discharge rollers 24 of the main body 1. In this manner, portions other than the return belt 31 of the copy sheet return station g are designed to be driven simultaneously with the copying means. The return belt 31 is designed to be rotated independently by a stepping motor 43.

The rotation of the driven gear 38 is transmitted to the sheet discharge rollers 34 and to the rollers 29 of the switchback station 26 by a timing belt 39. The rotation of the roller 29 is transmitted by gears 40 and 41 (FIG. 4) and a timing belt 42 to sheet feed rollers 33 for copying the underside of the sheet, and rotation of the roller 33 is changed to a speed substantially equal to the system speed in the copying means (for example, 25 sheets are copied per minute at a speed of 13 cm/sec and in a copying cycle of 2.4 sec/sheet).

In contrast thereto, the return belt 31 is driven intermittently by a certain amount every time copying is continuously effected in the copying means. For example, suppose that transmission of driving force from a motor 43 (FIG. 4) to the return belt 31 by a timing belt 44 is effected in a pulley ratio of 1:1 and that the diameter D of the pulley used is 31.8 mm. If the motor 43 is driven on a two-phase excitation system, a driving amount of l of return belt 31 per pulse at a stepping angle $\alpha$ of 1.8° of the motor 43 is 0.5 mm obtained from the following equation:

$$l = \frac{D}{\frac{360°}{\alpha}}$$

Accordingly, it is only necessary to send 36 pulses to the motor 43 to intermittently drive the return belt 31 by 18 mm every time the upside copying is continuously effected in the copying means.

Thus, each of the upside copied sheets successively sent onto the return belt 31 at the system speed from the switchback station 26 is returned to the image formation station a side by 18 mm by the return belt 31 every time upside copying is continuously effected in the copying means in the manner that the upside copied sheets are returned while being staggered 18 mm from each other with the succeeding one overlying the preceding one.

When underside copying is effected, only the upside copied sheets retained on the belt 31 are sent back to the image formation station a by the feed rollers 33 in the state of the upside copied sheet having been turned over through the reversing station f in properly timed relation brought about by adjustment of timing by temporary stop-adjustment rollers 21 and auxiliary timing rollers 22 in the midway of the sheet feed path 20. The time intervals at which each copied sheet on the return belt 31 reaches the sheet feed rollers 33 and is subjected to underside copying is at a rate of 3.4 seconds per sheet as expressed by the following equation:

$$18\ \text{mm} \div 7.5\ \text{mm/sec} = 2.4\ \text{sec}$$

Accordingly, the time interval is equal to the cycle of ordinary copying in the case of the upside copying and makes it possible to achieve underside copying of many copy sheets with the same efficiency as that with which ordinary copying is effected.

In the duplex copying apparatus including the duplex copying auxiliary means, it is possible to increase efficiency by dispensing with the waiting time necessary for operation of the copying apparatus from the time after upside copying to the time before underside copying by allowing the upside copied sheet to reach the specified position capable of underside copying immediately after completion of upside copying and by sending it the copying means for underside copying.

Referring now to the operation of the mechanism described above, the sheet discharge rollers 34, introduction rollers 28, 29 and feed rollers 29, 30 of switchback station 26, and sheet feed rollers 33 for underside copying are normally driven at a speed approximately equal to the system speed in the upside copying means (for example, 13 cm/sec). In contrast thereto, the return belt 31 keeps the upside copied sheet continuously copied in the copying means sent back to the image formation station side until completion of a specified number of upside copied sheets by driving the belt 31 at the above low speed or intermittently by independently disposing a drive motor or disposing a clutch-operated gear transmission in the drive system related with other rotational mechanisms than the motor. And after completion of the specified number of upside copied sheets, the upside copied sheets are rapidly sent to the specified return position capable of providing underside copying by driving the belt 31 at a speed higher than the above return speed (for example, 100 cm/sec), namely they are sent to the sheet feed rollers 33 for returning the copied sheets to the image formation stations a to thereby subject the upside copied sheets to underside copying.

Thus, it becomes possible to do away with or reduce the waiting time required for the upside copied sheet having not yet reached the specified return position when copying is changed from the upside to the underside of an original to replace the original by another original or to turn over the original for underside copying after the upside copying is over, with the result that efficiency in both side copying is increased to that extent. In orde to realize more efficient both side copying, it is desirable to increase not only the speed of return belt 31 but also that of passing the upside copied sheet in the switchback station 26 related with the time for returning the upside copied sheets.

All that is necessary for underside copying is to stop a copy sheet feed station in the copying means and to restore the return belt 31 and rollers 28, 29, 30 of switchback station 26 to the above low return speed or intermittent drive. The time for the restoration must be subject to the fact that the foremost one of the upside copied sheets has reached the specified return position and that an original has been replaced by another original or turned over for underside copying. Whether the foremost end sheet has reached the return position or not is decided by a detection signal of the photosensor 35 disposed in immediately in front of underside copying sheet feed rollers 33. Whether the original is ready for underside copying or not is decided in the case of a manual changeover system by whether underside copying has been started by an operator after the original is brought into the state ready for underside copying and in the case of an automatic changeover system by whether sufficient time has passed for an original feeding means to bring the original into a state ready for underside copying, or transfer operation of the original has ended, after the upside copying was effected.

When, in changeover of the copy sheet side to the underside thereof, upside copying is completed by the upside copied sheets having reached the preset number of sheets to be copied, the sheet feed station in the copying means is stopped independently of starting underside copying so that feeding of sheets for upside copying may not thereafter be effected. This is the same procedure as for conventional copying apparatuses.

In sequence control of the duplex copying operation described above, it is possible to stop the return belt 31 once without immediately accelerating the speed of the belt 31 even if upside copying has ended, drive the belt 31 at high speed from the time that a signal for starting underside copying has been given in the case of a manual changeover system and that a signal for readiness to effect underside copying has been given in the case of an automatic changeover system until the time that the photosensor 35 detects the foremost one of the upside copied sheets, restore sheet feed to normal speed simultaneously with detection by the photosensor 35 of the foremost end of the sheet, and start underside copying. Furthermore, when high-speed feed is effected, the time necessary for the foremost one of the upside copied sheets to reach the specified position after upside copying depends upon the number of sheets to be copied on the upside. Accordingly, uniform high-speed driving of the return belt after completion of the upside copying, when the accelerating rate of speed is set to the maximum number of both side copying sheets capable of permitting continuous copying, makes it necessary to have certain waiting time in proportion as the number of copy sheets becomes smaller than the maximum number of both side copying sheets. This problem can be solved by increasing the accelerating rate of speed of the belt 31 in accordance with decrease in the preset number of both side copying sheets.

In this manner, changeover of upside to underside copying can be made speedily without the waiting time required to return the upside copied sheets, so that a highly efficient apparatus of both side copying can be provided.

Incidentally, changeover of upside to underside copying made by the mechanism described above renders it possible effect copying at substantially the same interval of time as that at which one side copying is continuously carried out. Accordingly, the system of the type described is effectively used in a printer which outputs by converting an image signal as by the use of a laser (photoelectric conversion). (In this case of the printer, there is no need of changing originals but mere changeover of the image signals to be outputted will serve the purpose).

As described above, the duplex copying auxiliary means has a photosensor 35 located immediately in front of the feed rollers 33 of the return station g for detecting the foremost one of the upside copied sheets returned from the return station g to a side of the image formation station a. When the sensor 35 has detected the upside copied sheet, the sheet feed station b in the copying means and the return station in the duplex copying auxiliary means are stopped, the state of copying then in progress such as the number of upside copied sheets has been memorized and then the return station g is caused to operate to return the upside copied sheet to the image formation station a to preferentially copy the upside copied sheet to thereby effect both side copying. Such operation control can be achieved by sequence control made by a program cotrol device such as a microcomputer.

Figure 6:
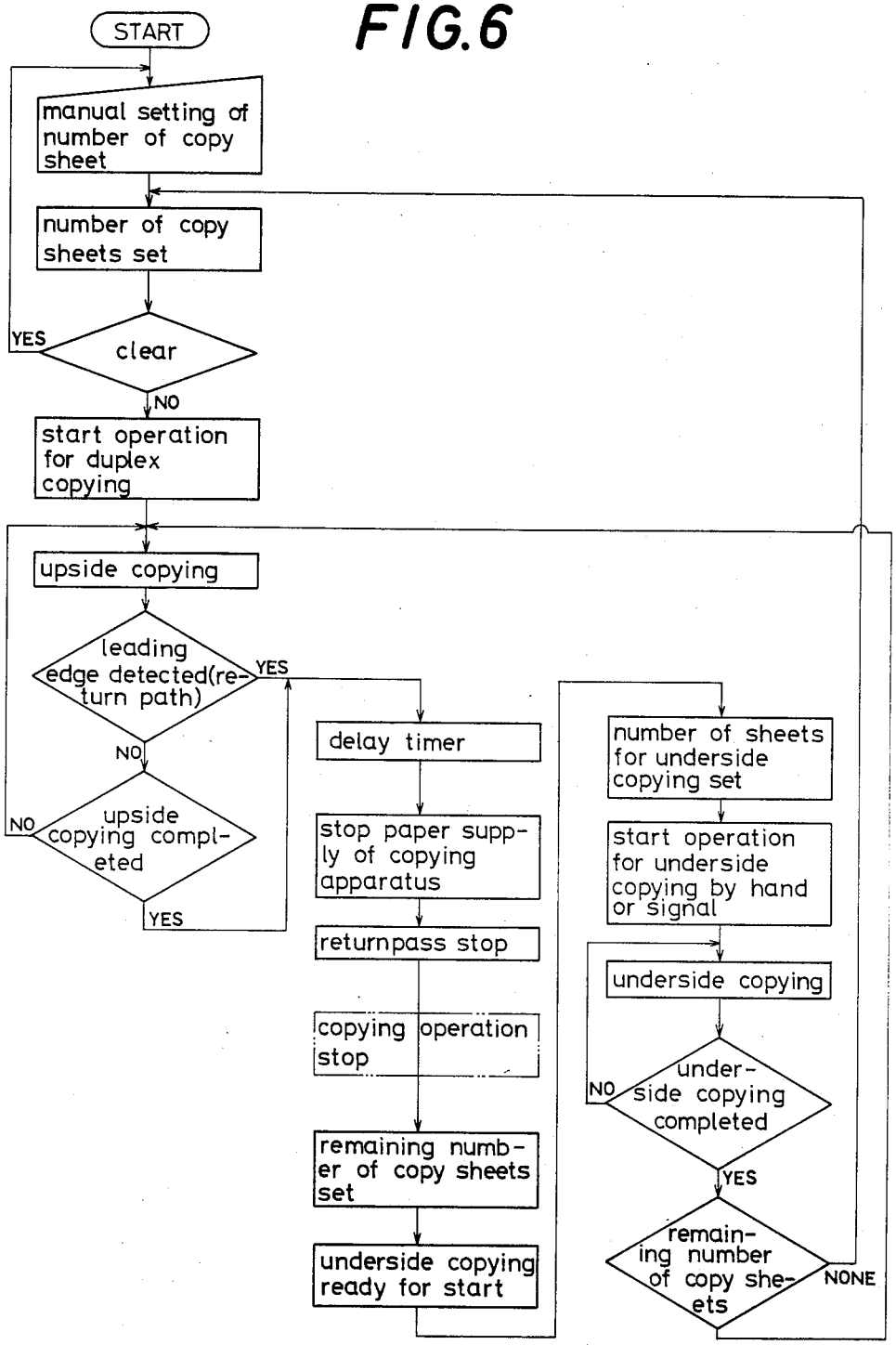
FIG. 6 is a flow chart showing sequence of each means of one side copying, return feed of one side copied sheet, and the other side copying.

A description will now be given of a series of more concrete operations in the case of both side copying with reference to the flow chart of FIG. 6. When the copying apparatus is started after the number of copy sheets to be copied on both sides is set, copy sheets are successively transferred from the sheet feed station b to the image formation station a and are continuously copied on the upside thereof in a copying means in accordance with the number of copy sheets preset. The upside copied sheet is received into the switchback unit d by the guidance of guide pawls 27*a* switched over in accordance with instructions on both side copying, and is transferred onto the return station g through the switchback station 26. The station g receives the upside copied sheet fed from the station 26 and returns the sheet to the image formation station a side.

Before the foremost one of the upside copied sheets returned is detected by the photosensor 35, the upside copying is continued until both side copied sheets amount to the number of sheets preset to be copied on both sides. When the photosensor 35 detects the foremost one of upside copied sheets returned, the sheet feed station b in the copying means and the return station g in the duplex copying auxiliary means are once stopped with adequate timing by a timer to thereby memorize the state of copying then in progress such as the number of upside copied sheets. By so doing, the residual number of upside copied sheets is calculated and set, and at the point of time at which the time sufficient to replace an original by another original or turn over the same has passed so as to permit the original to be subjected to underside copying, the number of upside copied sheets is set as the number of sheets to be copied on the underside. By actuating the return station g and sheet feed rollers 33 for underside copying, the upside copied sheet is returned to the image formation station a to subject the sheet to underside copying.

The temporary stop of the sheet feed station b in the copying means and the return station g in the duplex copying auxiliary means is to provide preparation time necessary for replacing an original by another original or turning over the original for underside copying before preferentially subjecting the upside copied sheet to underside copying.

Control of operation is possible as shown in phantom lines in FIGS. 4 and 5. In this case, underside copying is started by driving the apparatus again except for the sheet feed station b in the copying means.

Underside copying is continued until completion of the number of upside copied sheets preset as the number of sheets to be copied on the underside. When the underside copying is over, the inside and underside copying is made in the same manner unless the residual number of the sheets preset is out.

In upside copying, when upside copied sheets amount to the preset number of copy sheets, a timer operates regardless of detection by the photosensor 35 and makes changeover of final upside copying to the underside copying of the final upside copied sheet. By completion of the upside copying, however, the residual number of sheets preset becomes zero and the number of sheets to be copied on the underside thereof amounts to the number of the above final upside copied sheets. With this, underside copying is continued up to the number of the final upside copied sheets. When this final underside copying is over, the residual number of sheets becomes zero and the apparatus is restored to a state prior to starting of both side copying, and both side copying of the preset number of sheets is completed.

According to the illustrated embodiment of the invention, changeover of upside copying to a preferential underside copying state is automatically made in predetermined timed relation only when the foremost one of the upside copied sheets which are returned to the image formation station is returned to the specified position capable of underside copying. Accordingly, the invention is not only convenient in that there is no need of having to make manual changeover but also provides no possibility that the number of sheets to be subjected to continuous upside copying is so large that sheets for underside copying overlap sheets for upside copying, or that the number of sheets for continuous copying is so small that it takes more time than is necessary from the time for upside copying to that for underside copying.

When it is desired to make more than 20 both side copied sheets in the aforestated embodiment, it is necessary to repeat both side copying operation as many times as are required for the desired number of sheets at a rate of 20 copies for one operation. If both side copying is effected in the preset number of more than 20 copy sheets, the system of transferring copying from the upside to the underside of a copy sheet causes trouble. The most simple measure to avoid such possibility is to give alarm by a lamp a buzzer to prevent starting of the copying operation when the number of sheets to be set is greater than the maximum number of sheets to copy at the point of time at which a switch for both side copying is operated.

In order to stop the upside copied sheet, which is to be returned to the image formation station a through the sheet path 20, by stop-adjustment rollers 21 and correcting the direction of the leading end of the sheet to prevent oblique movement of the sheet and to adequately adjust timing in returning the sheet to the image formation station a, it is desirable that the sheet feed rollers 33 for underside copying be driven at a speed of, say, 15–30 cm/sec. slightly higher than the system speed.

Figure 7:
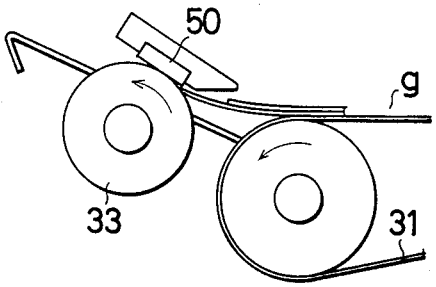
FIGS. 7 and 8 are respectively a side view and a sectional view, in part, of one embodiment showing a relation between a return belt and copy paper sheet feed rollers.
Figure 8:
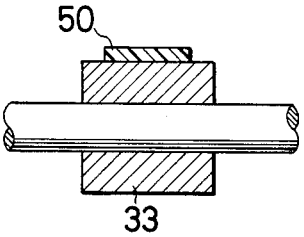
Figure 9:
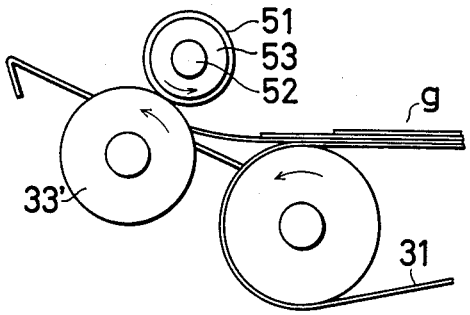
FIGS. 9 and 10 are respectively a side view and a sectional view, in part, of another embodiment of the apparatus.
Figure 10:
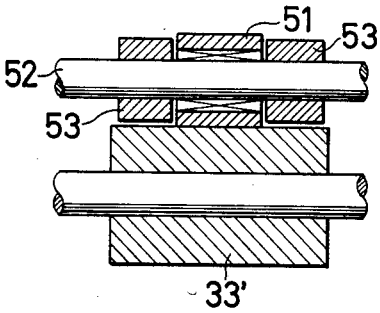

The upside copied sheets which are overlappingly returned to the low-speed return belt 31 are longitudinally dislocated or slipped out of place, for example by 18 mm and are subjected to underside copying one after another by the foremost one of the upside copied sheets being positively nipped between the rollers 33 every time copying of one sheet ends. But in practice, since it is difficult to draw out the foremost sheet from below the overlapping sheets without dragging the sheets overlying the foremost sheet, it is desirable to prevent the sheet succeeding the foremost sheet from following the foremost sheet by the use of a suitable gate or other brake members. For this purpose, in place of the upper one of the sheet feed roller pair 33 for underside copying, it is possible to use a polyurethane pad 50 adapted to be pressed into contact with the lower roller 33 as shown in FIGS. 7 and 8. Also, as shown in FIGS. 9 and 10, it is possible to prevent double feed of the overlapping upside copied sheets by disposing the succeeding sheets as by arranging as shown in FIGS. 9 and 10 a pair of reversely rotating rollers 53 mounted on each side of an upper roller 51, fixed to a shaft 52, slightly smaller in diameter than the roller 51, and driven in the direction opposite to that in which the upside copied sheets are conveyed. The use of the means described above in combination with the aforestated gate and brake would more positively prevent double feed of sheets.

Figure 11:
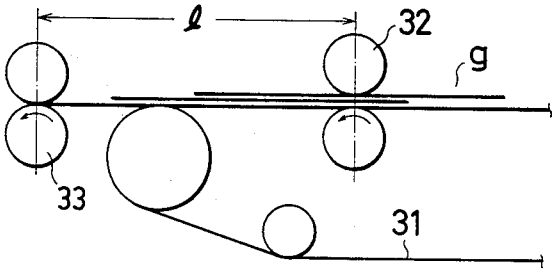
FIG. 11 is a side view showing, in part, another embodiment of the apparatus in FIGS. 7 to 10.

Furthermore, as other means of preventing double feed of sheets may be mentioned an attempt to make slightly shorter the distance l (FIG. 11) between the final auxiliary roller 32 and the sheet feed roller pair 33 in the return station g than the size of copy sheet in its transfer direction. For example, if in the case of transverse feed of a sheet of A4 size, the distance l is set such that l=210~192 mm, then the succeeding sheet is positively prevented from being overlappingly transferred by the succeeding sheet being restricted to low-speed transferring state sandwiched between the return belt 31 and the auxiliary roller 32 until the point of time at which the foremost upside copied sheet is nipped between the sheet feed rollers 33 and transferred onto the reversing station f.

Figure 12:
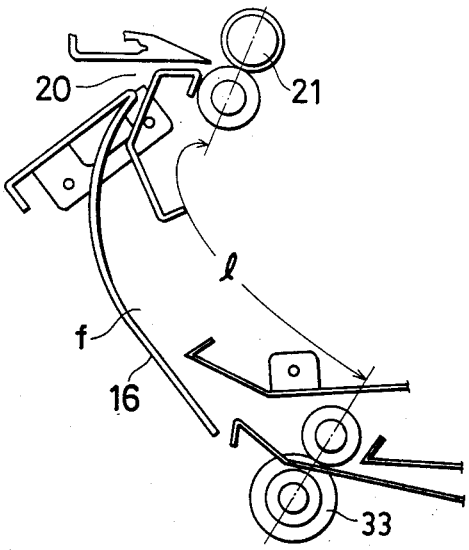
FIG. 12 is a side view showing, in part, still another embodiment of the apparatus.

Also, when, as shown in FIG. 12, the distance l is set between the rollers 33 and temporary stop-adjustment rollers 21, and the rollers 33 are driven at the same low speed as the return belt 31, double feed of sheets is prevented between the sheet feed rollers 33 and temporary stop-adjustment rollers 21. On the other hand, the distance l=210~192 mm between the rollers 33 and the rollers 21 may also be used in the range of low-speed return in which the upside copied sheets are retained. Accordingly, the maximum amount of sheets stacked, namely the maximum number of copy sheets possible in one cycle of both side copying can be increased to more than 20 sheets in the case of transverse feed of A4 size sheet.

Figure 13:
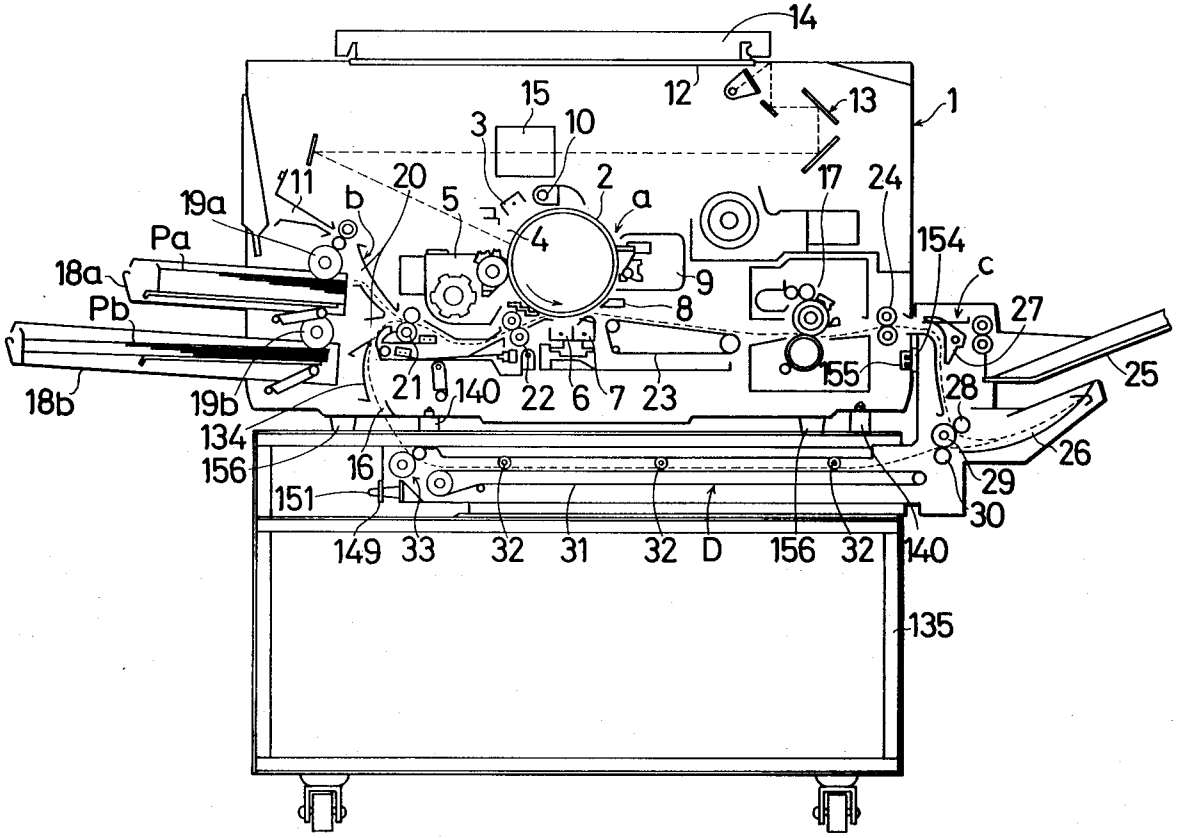
FIG. 13 is a sectional view of an inner mechanism showing one embodiment of an electrostatic copying apparatus including the duplex copying mechanism according to the invention.

FIG. 13 shows an embodiment of a mechanism wherein a duplex copying unit is set on a support unit 135 for exclusive use with a duplex copying apparatus so as to make possible both side copying by the use of an ordinary copying apparatus body.

For clear understanding, like reference characters and numerals are used to designate parts and elements similar to those used in the embodiment described above.

In FIG. 13, since the elements within the copying apparatus 1 and the copying operation are the same as those in the first embodiment, a description thereof is omitted. In the same manner as in the first embodiment, the upside copied sheet discharge station c is provided with a sheet discharge tray 25 for receiving and stacking the upside copied sheets therein which are being discharged. On the other hand, there is provided a (switchback) returning means D for changing the position of the upside copied sheet from the leading end to the trailing end thereof and transferring the sheet thus changed in position to a guide 134 for turning over and returning the sheet in the apparatus body 1. The switchback returning means D is detachably mounted, as will later be described, on the support unit 135 for exclusive use with a duplex copying apparatus on which stand the copying apparatus body 1 is set.

Figure 14:
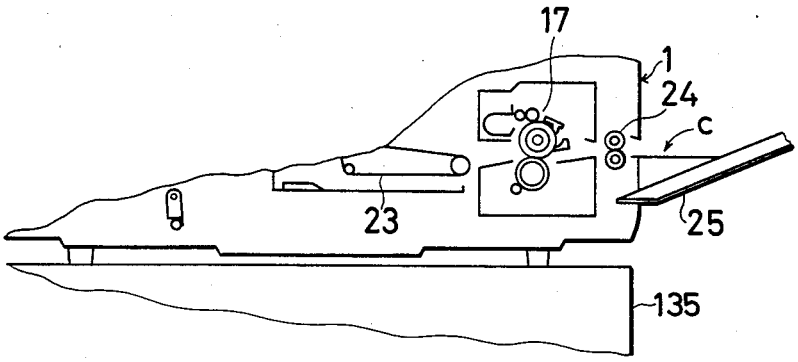
FIG. 14 is a segmentary sectional view of the copying apparatus and a mounting stand for the apparatus when the apparatus is used for copying one side of a copy sheet.

That portion of the switchback returning means D which is inserted into the support unit 135 is provided with a transfer belt 31 for returning to a sheet feed path 20 side the leading and trailing ends changed sheet transferred from the feed rollers 29, 30 of the path 20, a plurality of auxiliary rollers 32 in contact with the conveying surface of the belt 31, and feed rollers 33. The copying apparatus body is provided with the guide 134 for turning over and returning the sheet to a position just in front of stop-adjustment rollers 21 through the sheet feed path 20 from the feed rollers 33, the guide thus forming a transfer path 16 for returning the copied sheet to the sheet feed path 20. After the discharge tray 25 is disconnected from the switchback returning means D and the means is, in turn, disconnected from the support unit 135, the tray 25 is adapted to be mounted directly on the copying apparatus body 1 as shown in FIG. 14. In this case, after the switchback returning means D has been disconnected from the support unit, the opening 137 of the unit 135 (FIG. 15) is closed with a suitable lid.

Figure 15:
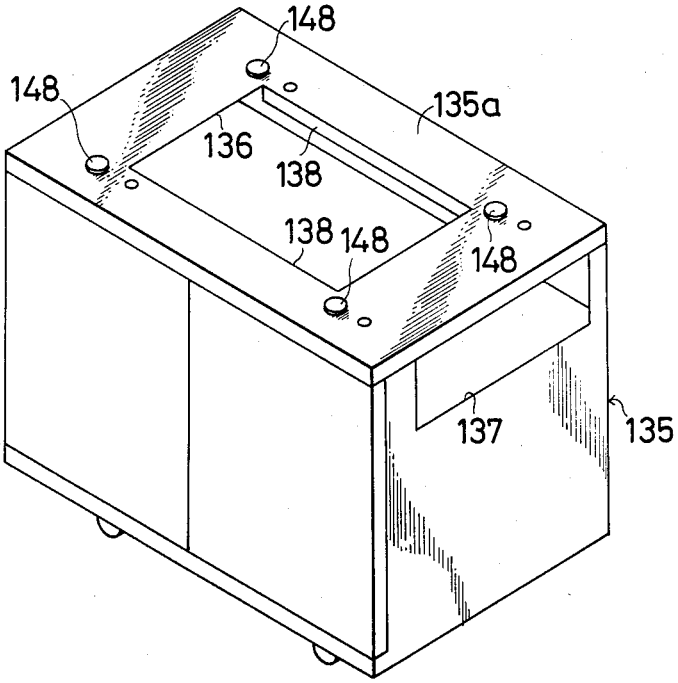
FIG. 15 is a perspective view of the mounting stand.
Figure 16:
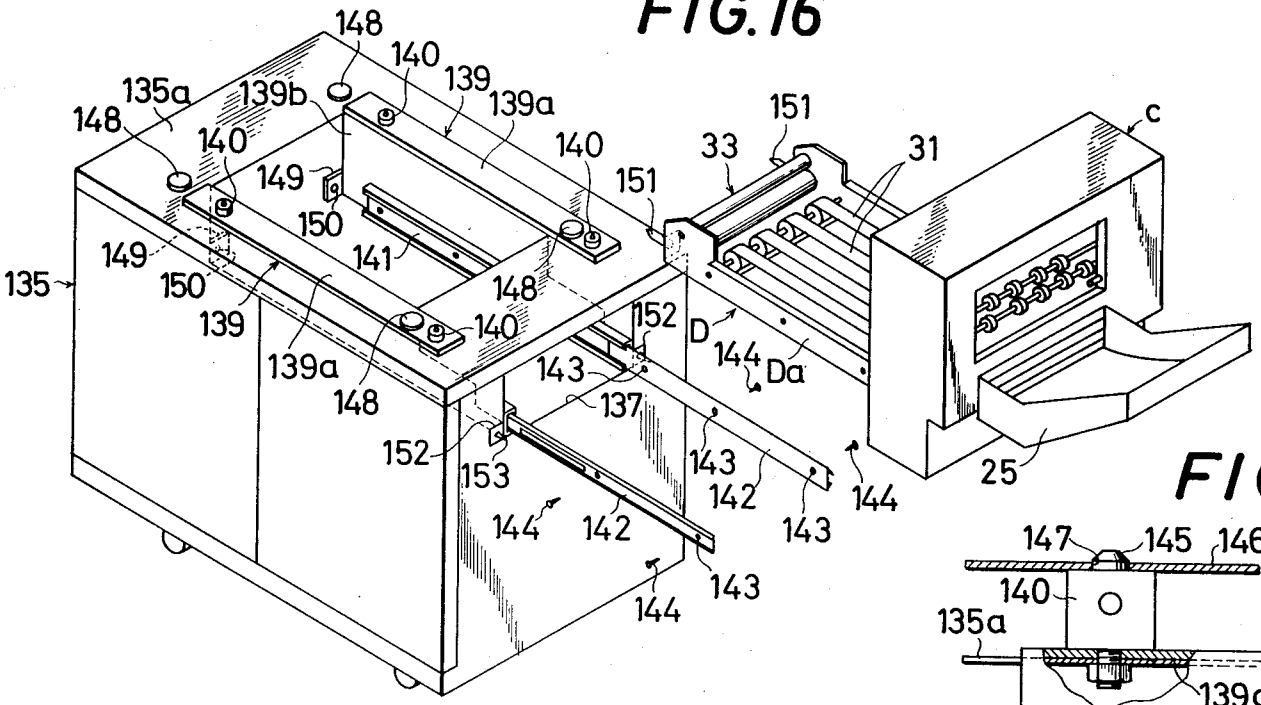
FIG. 16 is an exploded view in perspective when mounting the stand with a duplex copying unit.
Figure 17:
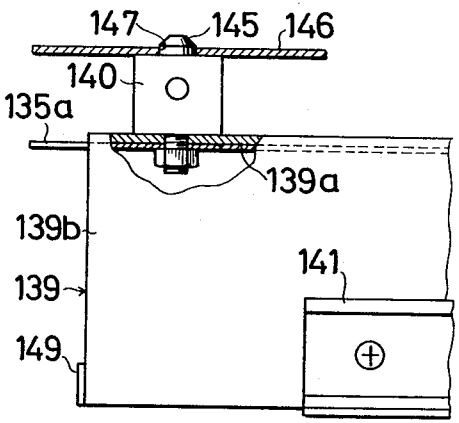
FIG. 17 is a sectional view showing the essential part of a means for bringing the copying apparatus into alignment with the mounting stand.

The unit 135, as shown in FIGS. 15, 16, and 17, is provided on the upper side with a square opening 136 for feeding the sheet returned from the switchback returning means D toward the sheet feed path 20 of the apparatus body 1. The unit 135 is provided on the lateral side with the square opening 137 for admittance into the support unit 135 comprising guide pawls 27 and the switchback returning means D. Each side of the opening 136 in the direction of sheet transfer is formed with an inwardly bent piece 138 as shown in FIG. 15. Along the respective bent pieces 138 are threadedly fixed the respective upper surfaces 139*a* of L-shaped rail fixing members 139 and 139 to the top plate 135*a* of the unit from above by a plurality of positioning members 140. To each rail fixing member 139 is fixed a channel section rail guide member 141 in the longitudinal direction of each vertical plane 139*b* of the member 139 placed inside the stand 135. The guide member 141 is provided with a travelling rail 142 slidably engaged with the member 141 so as to project outwardly from the opening 137. The duplex copying unit is fixed to the travelling rails 142, 142 with the duplex copying unit being placed on the rails 142, 142 drawn out from the opening 137, by fixing the side wall Da of the switchback returning means D to each travelling rail 142 by a plurality of screws 144 through holes 143 formed in the rail and can be stored in the support unit 135.

Positioning the apparatus body 1 with respect to the support unit 135 is carried out by forming a tapered projection piece 145 on the upper surface of a positioning member which threadedly fixes a rail fixing member 139 to the top plate 135 of the unit 135, and inserting the projection piece 145 through the hole 147 formed in the bed plate 146 of the apparatus body. In this case, it is possible to position the projection members by the use of the holes (not shown) provided by rubber legs 156 attached to the bed plate 146 of the apparatus body 1 having been detached from the plate 146. The numeral 148 designates members for receiving the rubber legs 156 provided on the top plate 135*a* of the support unit and on the upper surface 139 of the rail fixing member 139. When the duplex copying unit is positioned with respect to the support unit 135, positioning pins 151, 151 projected at the front end of the switchback returning means D are inserted through the unit positioning holes 150 in each inwardly bent piece 149 provided at the depth end of each rail fixing member 139. Simultaneously therewith, the duplex copying unit is positioned in the manner that the positioning pins 153 projected from the outwarly bent piece 152 on the opening 137 side of each rail fixing member 139 are inserted through the holes (not shown) formed on the corresponding surface of the unit. Connection of electrically related parts and elements and driving means related parts such as rollers and guide pawls 27 of the duplex copying unit is made by providing that portion of the unit abutting against the apparatus body 1 with a detachable locking means such as a male terminal 154 and female terminal 155 as shown in FIG. 13.

According to the structure described above, a duplex copying auxiliary unit comprising a path changeover means for making changeover of a copy sheet from a sheet discharge path to a switchback path and a switchback returning means for turning over the copied sheet transferred onto the switchback path the trailing and leading ends of the sheet reversed and returning the turned over sheet to the guide portion is mounted on the unit so as to make it possible for the switchback returning means portion to be stored in the unit for exclusive use with the apparatus body, with the advantageous result that, in comparison with the case wherein the duplex copying unit is attached to the apparatus body, the apparatus body is reduced in size and in production cost and also in the space necessary for installation of the copying apparatus. Also, viewed from the standpoint of a user, purchase of the copying apparatus body together with a stant for exclusive use therefor makes it possible to make one side copying, and when it is desired to increase efficiency by converting the apparatus to one for both side copying service, all that is necessary to do is to additionally purchase a duplex copying unit and a attaching member therefor and to attach the unit to the support unit, with the resulting advantage of reducing the expenses required for increased performance.

What is claimed is:

1. A duplex copying mechanism comprising:

a copying means having a sheet feed station, an image formation station for forming an image of an original on one side of a copy sheet feed from said sheet feed station, and a sheet discharge station from which a copied sheet passed through said image formation station is discharged; and a duplex copying auxiliary means for returning said copied sheet to said image formation station with the sheet thereof in a turned over state, said auxiliary means including a changeover gate station for effecting changeover of the transfer direction of sheet to said sheet discharge station as well as said auxiliary means itself, a switchback station for changing the feeding end for the trailing end of the sheet received therein, a return feed station for feeding the copied sheet from the switchback station toward the image formation side, a reversing station for feeding the copied sheet to the image formation station with the copied sheet being reversed, and means for driving said auxiliary means at a speed which is set lower than that of said sheet feed station of the copying means and at which the upside copied sheet is returned by the auxiliary means, whereby the upside copied sheets copied continuously by the copying means are returned to said image formation station with the sheets overlapping each other in staggered relation due to said speed difference during their return to said image station, and the underside copied sheets retained on said return feed station are successively fed to the image formation station through said reversing station for continuous underside copying operation when the foremost one of the underside copied sheets has reached the specified position in the return feed station.

2. A duplex copying mechanism according to claim 1 wherein said return feed station in said duplex copying auxiliary means is driven intermittently to move by a given distance every time copying operation is performed in said copying means.

3. A duplex copying mechanism according to claim 1, further comprising a detection means for detecting arrival of the foremost one of the upside copied sheets at said specified position in the return feed station of said duplex copying auxiliary means, whereby, when said detection means detects the sheet, the copy sheet feed station in said copying means and the return feed station in said duplex copying auxiliary means are stopped in predetermined timed relation, and a copying state then in progress such as the number of upside copied sheets is caused to memorize, thereafter the return feed station is caused to operate to feed the upside copied sheets to said image formation station to subject the upside copied sheets to preferential underside copying operation.

4. A duplex copying mechanism according to claim 1 wherein the feed speed of said duplex copying auxiliary means is adapted to accelerate immediately after completion of upside copying operation in said copying means to feed the upside copied sheet to the specified return position at high speed.

5. A duplex copying mechanism according to claim 1 wherein said duplex copying auxiliary means is provided in the space below the copying means of the copying apparatus.

6. A duplex copying mechanism according to claim 1 wherein said upper duplex copying auxiliary means is detachably mounted below the copying means of the copying apparatus.

7. A duplex copying mechanism according to claims 5 or 6 wherein the portion of said duplex copying auxiliary means which is inserted into the lower portion of the copying apparatus comprises a pair of feed rollers positioned at said switchback station, return belt having one end positioned with respect to said pair of feed rollers, a plurality of auxiliary rollers in contact with the belt surface of said return belt, and a pair of sheet feed rollers for feeding the upside copied sheets for underside copying positioned at the other end of said belt.

8. A duplex copying mechanism comprising:

a copying means having a copy sheet feed station, an image formation station for forming an image of an original on one surface of a copy sheet fed from said copy sheet feed station, and a copy sheet discharge station from which copied sheets having passed through said image formation station are discharged;

a duplex copying auxiliary means adapted to be used in combination with said copying means for returning the sheets copied on the upside by said copying means to said image formation station with the upside copied sheets being reversed, said duplex copying auxiliary means including a changeover gate for making changeover of the direction of passage to said sheet discharge station as well as the auxiliary means itself, a switchback station for changing the leading end to the trailing end of the upside copied sheet received therein and feeding out the switchbacked sheets, and a return feed station for feeding the switchbacked sheet to said image formation station side; and a support unit for supporting the copying means thereon and being provided with a mechanism for detachably receiving thereinto at least the return station of said duplex copying auxiliary means, whereby the copy sheets discharged from the sheet discharged station of said copying means are returned to said image formation station through the duplex copying auxiliary means mounted in said support unit.

9. A duplex copying mechanism according to claim 8 wherein said duplex copying auxiliary means is slidably provided in rail guide members fixed to the support unit.

10. A duplex copying mechanism according to claim 9 wherein said copying means is positioned by a positioning means for fixing the rail fixing members to said support unit.

11. A duplex copying mechanism according to claim 10 wherein said duplex copying auxiliary means and said rail fixing members are provided with locking means for setting the auxiliary means and fixing members in the specified positions.

12. A duplex copying mechanism according to claims 10 or 11 wherein that portion of said copying means abutting against said duplex copying auxiliary means is provided with a detachable locking means related with drive and electricity.

* * * * *